US009744792B2

(12) United States Patent
Kenney et al.

(10) Patent No.: US 9,744,792 B2
(45) Date of Patent: Aug. 29, 2017

(54) APPARATUS THAT IS CONVERTIBLE BETWEEN A SOCIAL EXPRESSION AND A DECORATIVE ITEM

(71) Applicant: Nicole B. Wilson, Brunswick, OH (US)

(72) Inventors: Genevieve N Kenney, Cincinnati, OH (US); Nicole B Wilson, Brunswick, OH (US)

(73) Assignee: Nicole Wilson, Brunswick, OH (US)

( * ) Notice: Subject to any disclaimer, the term of this patent is extended or adjusted under 35 U.S.C. 154(b) by 0 days.

(21) Appl. No.: 14/866,978

(22) Filed: Sep. 27, 2015

(65) Prior Publication Data

US 2017/0087917 A1 Mar. 30, 2017

(51) Int. Cl.
*G09F 1/06* (2006.01)
*B42D 15/04* (2006.01)

(52) U.S. Cl.
CPC ..... *B42D 15/042* (2013.01); *G09F 1/06* (2013.01)

(58) Field of Classification Search
CPC .... B42F 5/00; B42F 17/18; G09F 5/04; G09F 5/042
See application file for complete search history.

(56) References Cited

U.S. PATENT DOCUMENTS 2,415,501 A * 2/1947 Klein ..... B42D 15/042 40/124.16
5,317,823 A * 6/1994 Brunt, II ..... G09F 1/08 206/308.1
6,149,111 A * 11/2000 Epstein ..... A47G 33/12 248/152
6,179,437 B1 * 1/2001 Hardy ..... F21S 13/00 29/513
2006/0156594 A1 * 7/2006 Dansby ..... B42D 9/007 40/124.16

FOREIGN PATENT DOCUMENTS

JP 2003122253 A * 4/2003

* cited by examiner

*Primary Examiner* — Cassandra Davis
(74) *Attorney, Agent, or Firm* — Rankin, Hill & Clark LLP

(57) ABSTRACT

An apparatus that is convertible between a social expression, such as a wedding invitation, and a decorative item, such as a votive candle holder. As a social expression, the apparatus is a flat, metal sheet which includes information pertaining to a social event that can be placed in an envelope and mailed to a recipient. Once the recipient receives the social expressions piece and the information regarding the social event is conveyed, the recipient can convert the social expression into a decorative item by folding along one or more folding lines. By converting the social expression into a decorative item, the apparatus has a greatly extended life.

7 Claims, 7 Drawing Sheets

FIG. 9
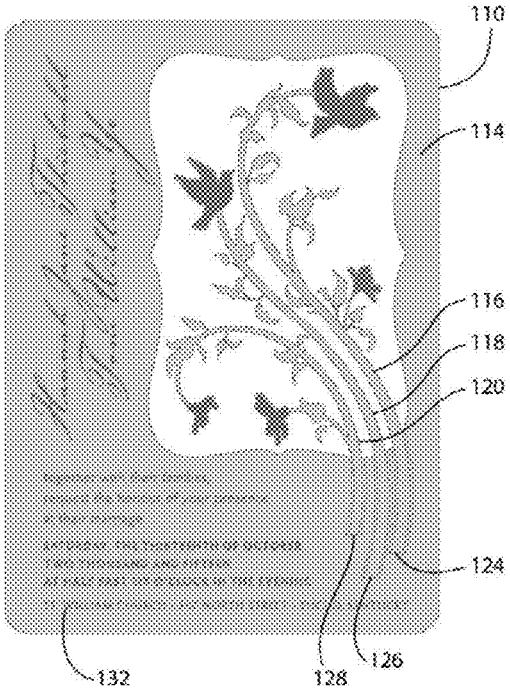
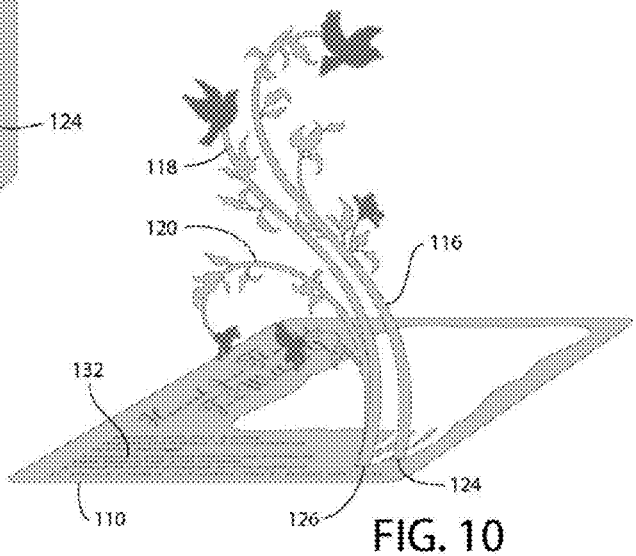
FIG. 10
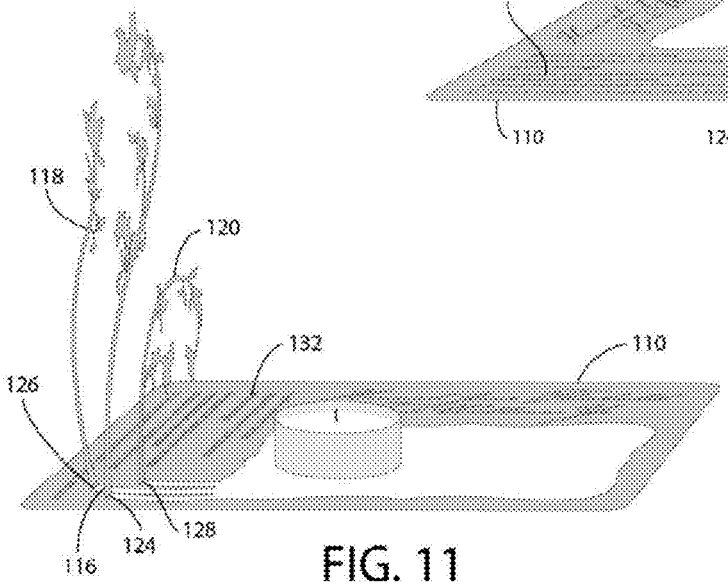
FIG. 11

FIG. 12
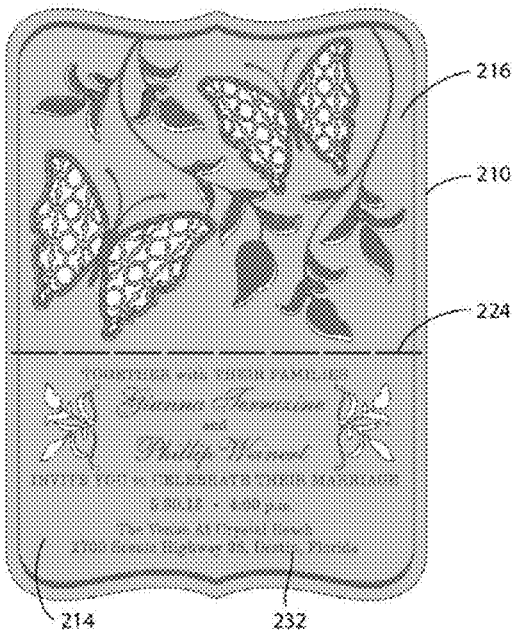
FIG. 13
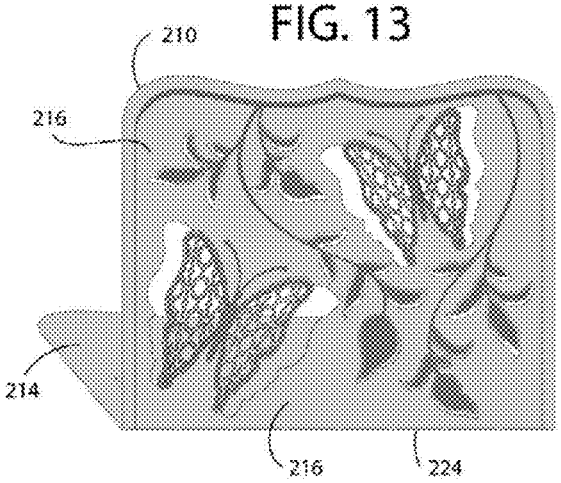
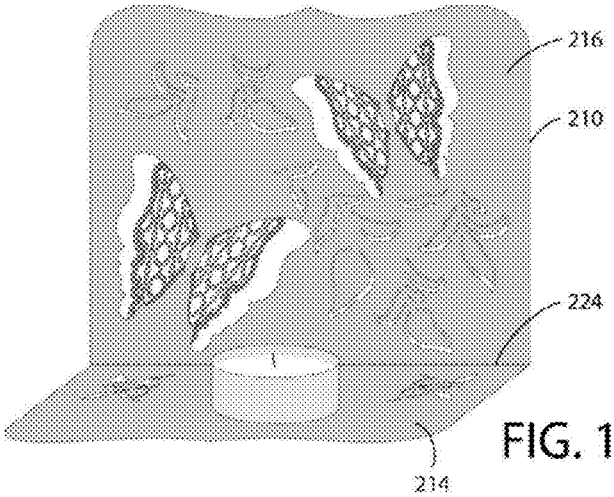
FIG. 14

APPARATUS THAT IS CONVERTIBLE BETWEEN A SOCIAL EXPRESSION AND A DECORATIVE ITEM

CROSS-REFERENCE TO RELATED APPLICATIONS

This application claims the benefit of U.S. Provisional Application No. 62/055,714, filed on Sep. 26, 2014.

BACKGROUND OF THE INVENTION

A. Field of the Invention

The present invention relates to an invitation or social expressions piece, and more particularly, a social expressions piece produced from a sheet of metal that is convertible from the social expressions piece to a decorative item.

B. Description of Related Art

Social expressions are abundant in the art. Most are made of paper, though more unique materials are currently being introduced in innovative applications. Higher end materials, such as wood and metal are making their way into specialty markets but are relatively few by comparison.

An unfortunate result of sending social expressions is the waste. The invitations and cards are received, read, and disposed of quickly. The recipient may hold on to it for a period of time if he/she is especially sentimental, but typically social expressions pieces have a short life-span and cannot be transformed into another useful purpose.

Attempts have been made to encourage the recipient to create something out of the social expressions paper. A description of a few examples of prior art follows.

U.S. Pat. No. 4,087,576 to Patterson provides for a panel that can be removed from the paper greeting card and the recipient can punch out an ornament to be hung for decorative purposes. While decorative, this does not dissuade the recipient from discarding the remaining card since paper is generally perceived as temporary and not valuable.

U.S. Pat. No. 4,515,838 to Miyajima discloses a metal sheet to be printed on with a planar writing medium affixed to the back side of the metal.

U.S. Pat. No. 6,179,437 to Hardy discloses stamping a metal blank to form a candle holder which can be sold in a flat, unfolded state and mailed in an envelope to a gift recipient who can then fold the candle holder's panels. Though the end product is a home décor product, it does not have the added benefit of being utilized as a social expressions piece as its primary intended use.

The prior art has shortcomings. None of the above-cited prior art documents acts as both a social expression and a decorative item, where the entire social expression is converted into a decorative item without waste. The present invention overcomes these, and other, shortcomings in the art.

OBJECTS AND SUMMARY OF THE INVENTION

The present invention is an apparatus that is convertible between a flat, mailable social expressions piece and a folded, three-dimensional decorative item. The apparatus includes at least a first panel separated from a second panel by a first folding line, a third panel separated from the second panel by a first cut-out, a fourth panel is separated from the third panel by a second folding line, and is separated from the first panel by a third folding line, and information pertaining to a social event is located on one or more of the first, second, and/or third panel. Preferably, all or substantially all of the information pertaining to a social event is located on a first side of the first panel. The apparatus is-formed from sheet metal. The first folding line and the second folding line are not co-axial such that, when the first, second and third folding lines are folded by an end user, the second side of the first panel forms a platform for placing a candle thereon. The entire social expression is present in the decorative item after folding along the folding lines is complete (i.e., there is no waste or portions of the social expression that are discarded during the conversion from the social expression to the decorative item). The additional panels (e.g., second, third, fourth, etc) can also include some of the information pertaining to the social event and/or other ornamentation.

A first object of the present invention is to provide a metal invitation or other social expressions piece that is mailed in an envelope or box for the primary, intended use of conveying information regarding a social event, such as a wedding.

Another object of the present invention is to provide a decorative item that is formed when the social expression and then the metal can be easily manipulated by the recipient to create a decorative item for a secondary, unlimited use in the home or office.

A further object of the present invention is to convert the social expression to the decorative item while eliminating waste.

The above objects are achieved in accordance with the present invention through the provision of the social expressions piece formed from a metal sheet and being chemically etched or laser cut and including a series of panels and folding lines disclosed in detail below.

BRIEF DESCRIPTION OF THE DRAWINGS

The present invention will be more fully appreciated as the same becomes better understood from the following detailed description of the present invention when viewed in conjunction with the accompanying drawings, in which:

FIG. 9 is a top view of a second embodiment of the present invention before mailing to the recipient, in an unfolded state;

FIG. 10 is a perspective view of the embodiment shown in FIG. 9 in the folded state;

FIG. 11 is a perspective view of the embodiment shown in FIG. 10 in the folded state in use with a candle votive set thereon;

FIG. 12 is a top view of a third embodiment of the present invention before mailing to the recipient, in an unfolded state;

FIG. 13 is a perspective view of the embodiment shown in FIG. 12 in the folded state;

FIG. 14 is a perspective view of the embodiment shown in FIG. 12 in the folded state in use with a candle votive set thereon;

DETAILED DESCRIPTION

Figure 1:
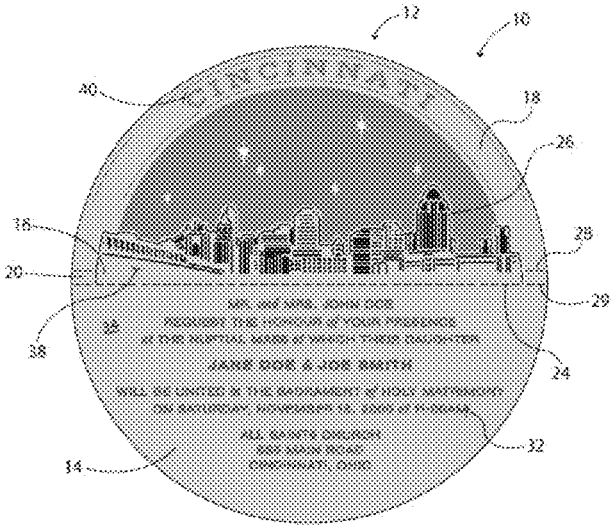
FIG. 1 is a top view of one embodiment of the present invention before mailing to the recipient, in an unfolded state.

Referring to FIG. 1, the apparatus 10 of the present invention includes a social expressions piece 12 that includes a first panel 14, a second panel 16, a third panel 18, a fourth panel 20, and a fifth (optional) panel 22. The first and second panels 14, 16 are separated by a first folding line 24. The third panel 18 is separated from the second panel 16 by a first cut-out 26 (see e.g., FIGS. 1, 2 and 3). The third panel 18 is also separated from the first panel 14 by the fourth and (optional) fifth panels 20, 22. The third panel 18 is separated from fourth and (optional) fifth panels 20, 22 by a second folding line 28. The fourth and (optional) fifth panels 20, 22 are separated from the first panel 14 by third folding line 29.

The apparatus 10 is convertible between a generally flat social expressions piece 12 (e.g., a wedding invitation) and a folded, three-dimensional decorative item 30 (e.g., a candle votive). The apparatus 10 is formed from a single, unitary piece of sheet metal. Common types of sheet metals include aluminum, brass, copper, steel, tin, nickel and titanium. For decorative uses, important sheet metals also include silver, gold, and platinum.

Figure 2:
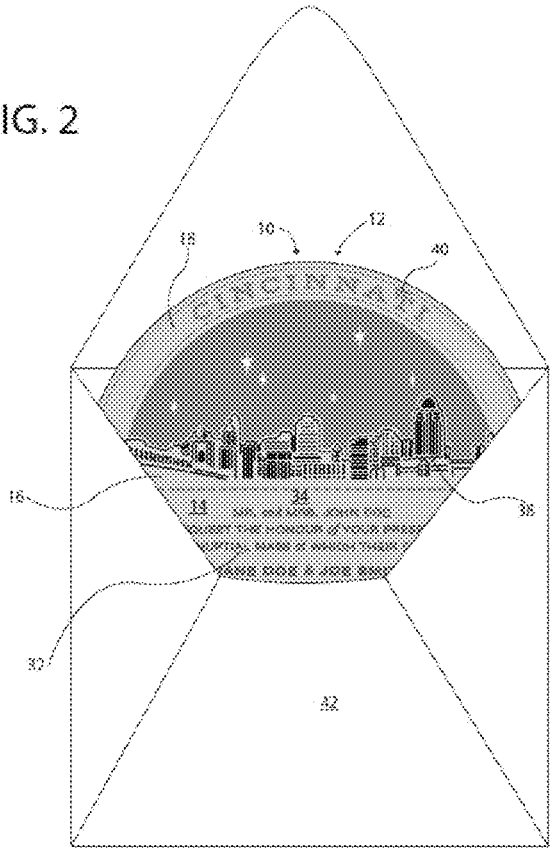
FIG. 2 is a top view of an embodiment of the present invention showing the social expression being placed in an envelope.
Figure 3:
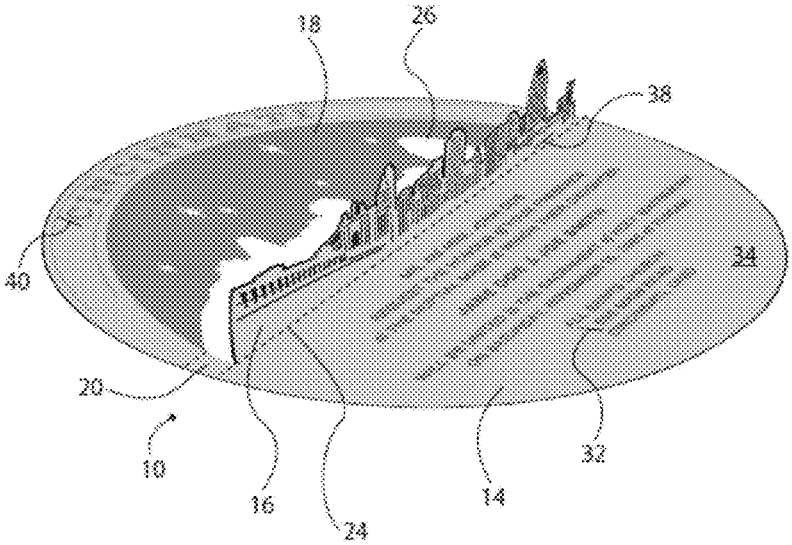
FIG. 3 is a perspective view of an embodiment of the present invention as it transforms from a social expression into a decorative item, showing the second panel of the invitation folded along a first folding line.

Referring now to FIGS. 1-3, the outer shape of the apparatus 10 can be any type desired based on aesthetics and size. In the embodiment shown, the outer shape is generally round. However, other shapes (e.g., triangular, rectangular, irregular) can be utilized based on the needs and wants of the designer. Preferably, when positioned as a flat, social expressions piece 12, it is preferable that the outer shape is sized so that it will fit into one of the numerous standard sizes of envelopes that are readily commercially-available (see e.g., FIG. 2). However, the present invention should not be considered to be limited by any particular size or outer shape. The apparatus 10 can have any thickness (see FIG. 3) since sheet metals are readily available in a variety of thicknesses. Preferably, the sheet metal used is 0.35 mm thick since it is readily available and easily folded by an end user.

Continuing to refer to FIGS. 1-3, the first panel 14 is shaped based on the part it plays in the overall design of the social expressions piece 14 and/or decorative item 30. In the embodiment shown, the first panel 12 is semi-circular in shape. The first panel includes first side 34 and a second side 36. Preferably, the first side 34 of the first panel 14 includes information 32 relating to a social function, such as a wedding. Information 32 provided can be information generally found in a wedding invitation, such as but not limited to names, locations, dates, and times. Alternatively, the information may not disclose an event, but may include a general greeting (e.g., a birthday wish or congratulations). The information can be included on the apparatus in any suitable manner, or manners. For instance the information can be printed directly onto the apparatus in paint or ink. The paint or ink can include one or more colors. Alternatively, the information can be etched chemically, or otherwise imprinted or embossed into the metal (e.g., laser engraved). A combination of etching and/or imprinting and printing of the information can be utilized. Another alternative is to simply punch out the letters, numbers and/or symbols of the information so that the material is completely removed from the apparatus. The first panel can optionally further include design elements such as cut-outs of one or more designs or images. In embodiments where the apparatus 10 is used as a candle votive, the first panel is sized such that a candle can be positioned on the second side 36 of the first panel when it is folded into the decorative item (discussed infra).

A first folding line 24 separates the first panel 14 from the second panel 16. The first folding line 24 is a weakened section in the sheet metal that is formed by any one of the commonly known means. For instance, a series of holes or slots can be punched or cut with a laser along a line to create the first folding line 24. Alternatively, the first folding line can be created by simply weakening, without cutting through the apparatus (e.g., by creating a groove in the sheet metal). Although the first folding line 24 is shown as a continuous line in the embodiment shown in, e.g., FIG. 1, the folding line can be split into two or more lines that are co-axial.

The second panel 16 is separated from the third panel by the first cut-out 26. The second panel 16, like the first panel 14, can be shaped based on the part it plays in the overall design of the social expressions piece 14 and/or decorative item 30. In the embodiment shown, the second panel is shaped to reflect the cityline of the city of Cincinnati. Therefore, the first cut-out generally follows the shape of the cityline image shown in, e.g., FIG. 1. In addition to, or alternatively, the second panel 16 can include some or all of the information 32. Images 38 and/or information 32 provided on the second panel 16 can be provided in any of the manners described above (e.g., printing, etching, cut-outs, etc) in relation to the first panel 14.

The second folding line 28 separates the third panel 18 from the fourth and (optional) fifth panels 20, 22. The second folding line 28 can be formed in a manner consistent with that described above in relation to the first folding line 24. In some embodiments, the first and second folding lines 24, 28 are formed in a generally similar manner. However, the second folding line 28 does not necessarily need to be formed using the same technique as the first folding line 24 in all embodiments. For example, in some embodiments, the first folding line 24 can be formed with a groove and the second folding line 28 can be formed with a series of holes, or vice versa.

The third panel 18, like the first and second panels 14, 16, can be shaped based on the part it plays in the overall design of the social expressions piece 14 and/or decorative item 30. In the embodiment shown, the third panel 18 is generally semi-circular on the upper portion, and the lower portion is defined by the first cut-out 26. The third panel 18 can include some or all of the information 32. Images 40 and/or information 32 provided on the third panel 18 can be provided in any of the manners described above (e.g., printing, etching, cut-outs, etc.) in relation to the first and second panels 14, 16.

The fourth and (optionally) fifth panels 20, 22 are separated from the first panel by a third folding line 28, and from the second panel 16 by the first cut-out 26. The fourth and (optionally) fifth panels 20, 22 are generally present to provide depth to the decorative item 30 when in the final folded form. Therefore, they are sized and shaped to provide the desired effect. Generally, these panels 20, 22 do not include features, but can include design features in a similar manner to the first, second and third panels 14, 16, 18 described above.

The third folding line 29 separates the first panel 14 from the fourth and (optional) fifth panels 20, 22. The third folding line 28 can be formed in a manner consistent with that described above in relation to the first and second folding lines 24, 28. The third folding line can be a continuous line, or as shown in, e.g., FIG. 1, in two or more generally co-axial sections.

In use, the apparatus is created in a generally flat form by forming the social expressions piece 12 in a series of, e.g., stamping, etching and/or printing steps as shown, for example, in FIG. 1. The social expressions piece 12 is then placed in an envelope 42, and mailed to the recipient, as shown in FIG. 2. When received by the end user, the social expressions piece 12 is removed from the envelope 42, and the information 32 pertaining to the social event is transferred to the end user when read.

Figure 4:
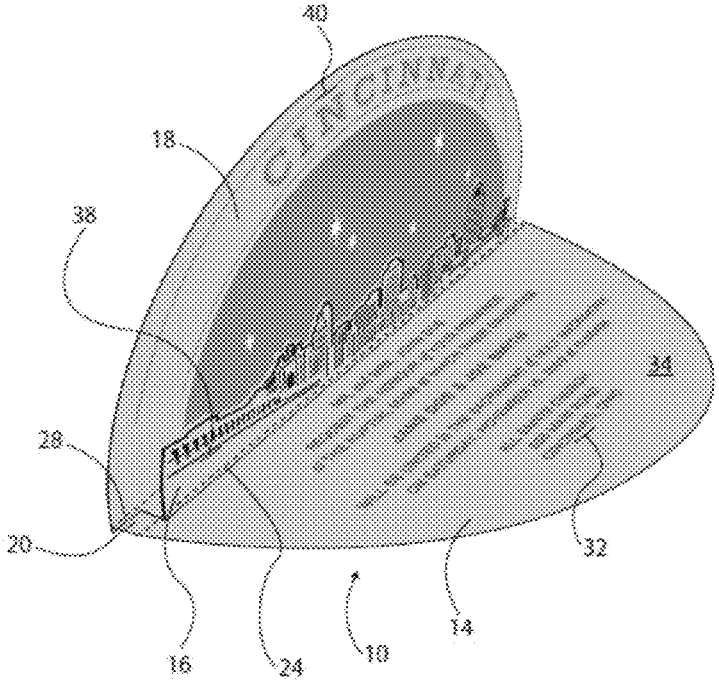
FIG. 4 is a is a perspective view of an embodiment of the present invention showing a third panel folded along a second folding line.
Figure 5:
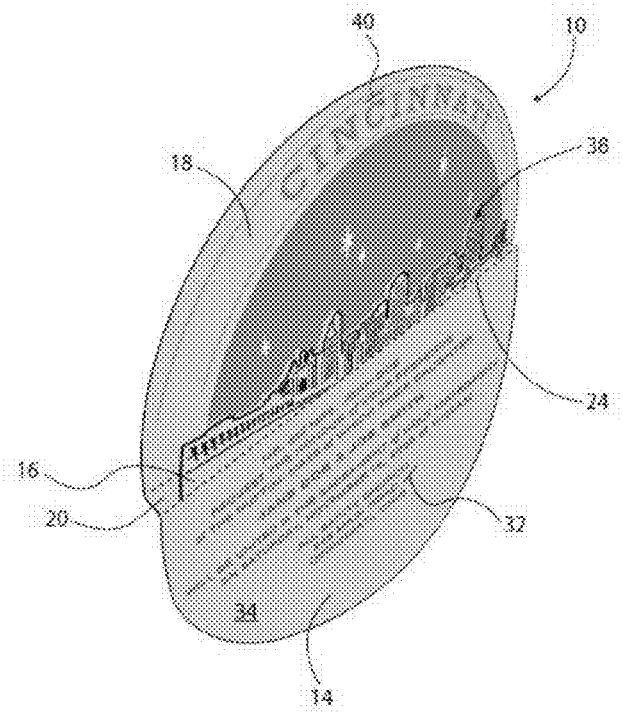
FIG. 5 is a is a perspective view of an embodiment of the present invention showing a first panel of the invitation folded along a third folding line such that a second side of the first panel create a base for placing a candle thereon.
Figure 6:
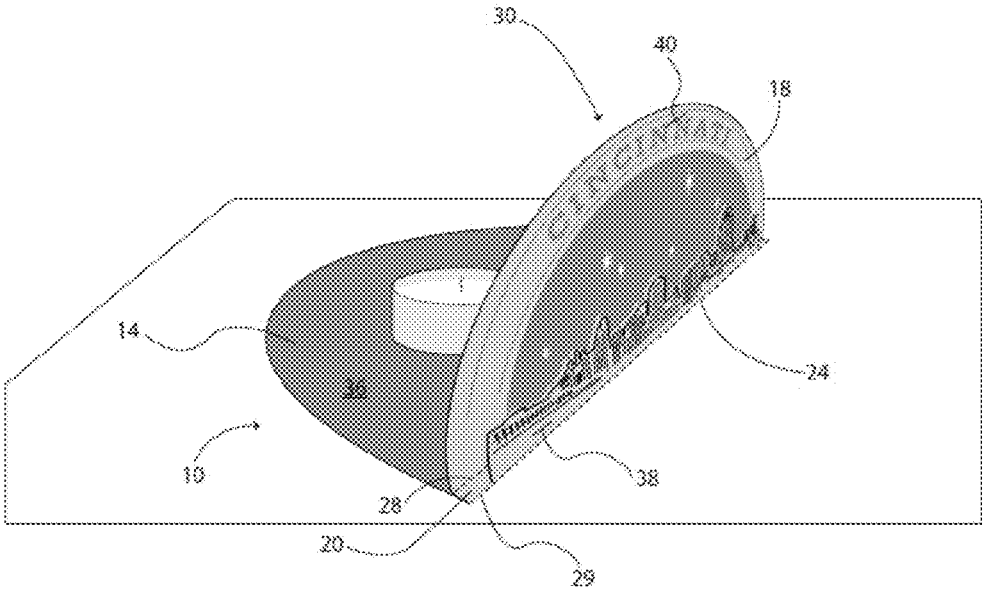
FIG. 6 is a perspective view of an embodiment of the present invention folded into a decorative item with a candle placed on the second side of the first panel behind the second and third panels such that light from the candle illuminates the various panels of the decorative item.
Figure 7:
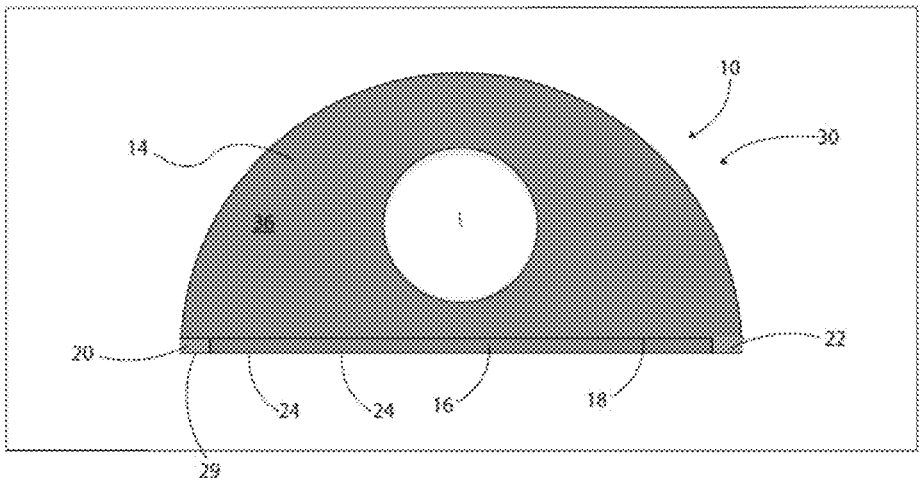
FIG. 7 is top view of the embodiment shown in FIG. 6.
Figure 8:
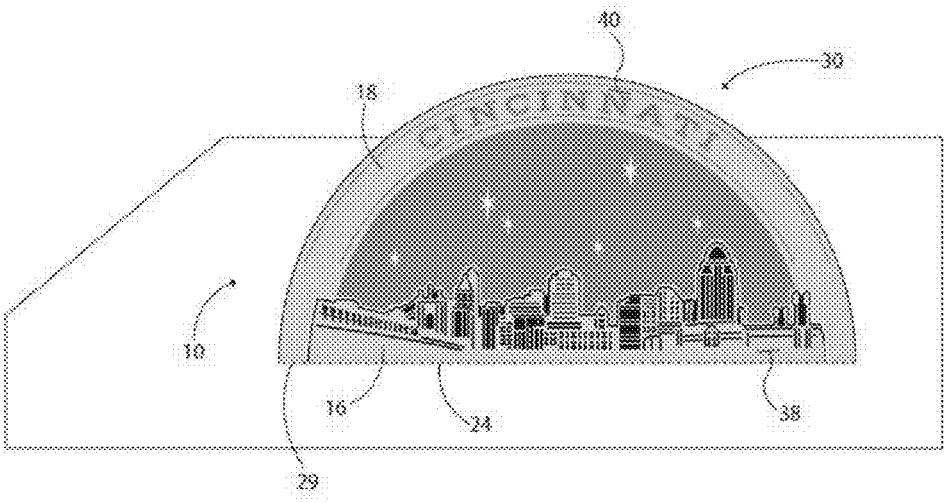
FIG. 8 is a front view of the embodiment shown in FIG. 6.

Rather than discarding or recycling the social expressions piece 12, the end user folds the social expressions piece 12 into the decorative item 30 by folding the apparatus 10 along the first, second and third folding lines 24, 28, 29. The degree about which the various panels are folded can vary depending on the desire of the designer and/or end user. In the embodiment shown, the second panel 16 is folded approximately 90 degrees relative to the first panel 14 at the first fold line 24 (see FIG. 3). As shown in FIG. 4, the third panel 18 is then folded relative to the fourth and fifth panels 20, 22 at an approximately 90 degree angle (see FIG. 4). Now referring to FIGS. 5 and 6, the first panel is folded about 180 degrees relative to its original position (as shown in e.g. FIG. 4) about the third folding line 29.

Once the folding is completed, the social expressions piece 12, such as a wedding invitation, is converted into a reusable decorative item 30, such as a votive candle holder, instead of trash. In the votive candle holder form, the decorative item 30 is placed on a surface so the second side 36 of the first panel 14 is placed so that it is facing upwards. The end user can then place a candle on the second side so that, when the candle is lit, the light illuminates the various features (e.g., the images 38, 40).

Alternative embodiments are shown in FIGS. 9-12, 13-15, and 16-18.

Referring now to FIGS. 9-12, a second embodiment is shown. Referring to FIG. 9, the apparatus 110 is formed from a single, unitary piece of sheet metal (or similar material). In the embodiment shown, there is a first panel 114 that includes information 132. Additional panels 116, 118, 120 are all generally shaped like flowers, leaves and birds. The additional panels 116, 118, 120 are all separated from the first panel by folding lines 124, 126, 128. Folding lines 124, 126, 128 are all generally parallel, but offset from one another. The end user can determine the amount the additional panels 116, 118, 120 are bent about the fold lines 124, 126, 128. In the embodiment shown, the additional panels 116, 118, 120 are bent approximately 90 degrees relative to the first panel 114. Additionally, in order to provide more three-dimensional features, the end user can optionally curve the panels to make them appear more attractive and/or lifelike. Referring to FIG. 11, the folded apparatus 110 can be used as, e.g., a candle votive. In this embodiment, the information 132 is visible to the user when folded and used as a candle votive.

Referring now to FIGS. 12-14, a third embodiment of the present invention is shown. In this embodiment, the apparatus 210 includes a first panel 214 that include information 232 and is separated from a second panel 216 by a fold line 224. The second panel 216 includes additional cut-outs to add decorative features (e.g., butterflies). In embodiments like these, the end user is able to bend the cut-out features, as shown in FIG. 13, as desired. Fold lines can be optionally provided to assist the end user in the folding process for features such as these. Referring to FIG. 14, the folded apparatus 210 can be used as, e.g., a candle votive. In this embodiment, the information 132 is not visible to the user when folded and used as a candle votive because it is on the underside of the first panel 214 during use as the candle votive.

Figure 15:
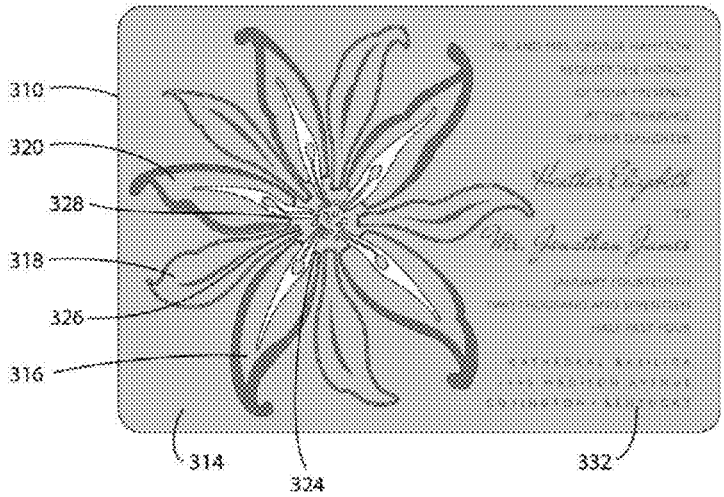
FIG. 15 is a top view of a fourth embodiment of the present invention before mailing to the recipient, in an unfolded state.
Figure 16:
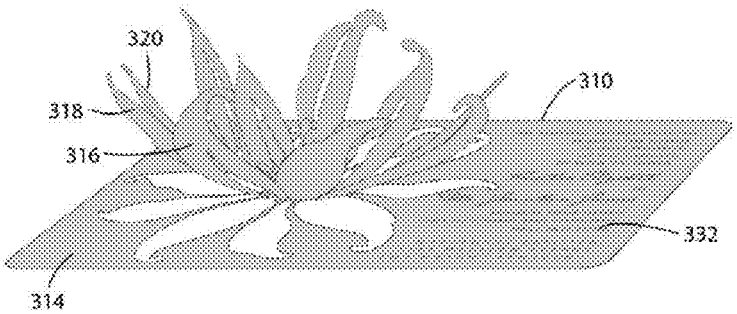
FIG. 16 is a perspective view of the embodiment shown in FIG. 15 in the folded state.
Figure 17:
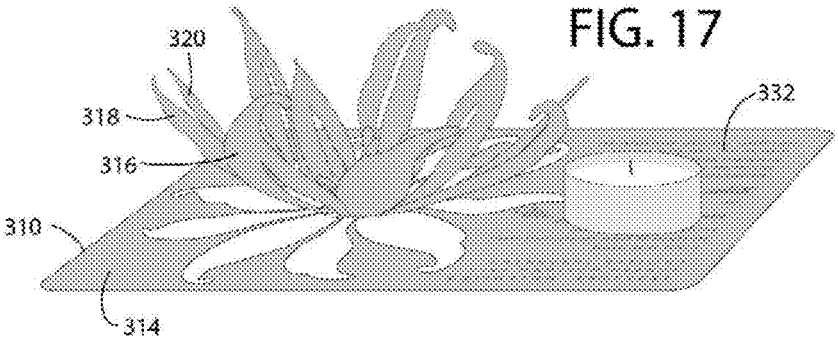
FIG. 17 is a perspective view of the embodiment shown in FIG. 15 in the folded state in use with a candle votive set thereon.

Referring now to FIGS. 15-17, a fourth embodiment is shown. In this embodiment, the apparatus 310 includes a first panel 314 includes information 332 and includes at least three (3) cut-outs and optionally more (as shown in FIG. 15). Each cut-out forms decorative panels 316, 318, 320 that are separated from the first panel 314 by folding lines 324, 326, 328. Notably, in the embodiment shown, folding lines 324, 326, 328 are at arranged at an angle relative to each other. In addition, the additional panels are shown bent at an angle less than 90 degrees relative to the first panel 314, and each has been curved by the end user for display.

While the present invention has been described in its preferred embodiments, it is to be understood that the invention is not limited thereto; but may be otherwise embodied. For example, the apparatus 10 can include additional panels and folding lines. In addition, one or more folding lines can be positioned co-axial to one another, or positioned so that they are not co-axial to one another. Furthermore, features from one embodiment can be imported to another embodiment without departing from the scope or spirit of the invention.

We claim:

1. An apparatus that is convertible between a flat, unfolded social expressions piece and a folded, three-dimensional decorative item, comprising:

a first panel separated from a second panel by a first folding line;

a third panel separated from the second panel by a first cut-out;

a fourth panel separated from the third panel by a second folding line, and separated from the first panel by a third folding line;

information pertaining to a social event located on one or more of the first, second, and/or third panel; and wherein the apparatus is formed from sheet metal;

wherein the first folding line and the second folding line are not co-axial such that, when the first, second and third folding lines are folded by an end user, the apparatus is converted from a flat, unfolded social expressions piece to a folded three-dimensional decorative item, a second side of the first panel forms a platform for placing a candle thereon, and the entire social expressions piece is converted to the decorative item.

2. The apparatus of claim 1, wherein the information is etched into the sheet metal.

3. The apparatus of claim 1, wherein the information is printed onto the sheet metal.

4. The apparatus of claim 1, wherein the information is punched through into the sheet metal.

5. The apparatus of claim 1, wherein at least one of the first, second or third folding lines is formed by a series of holes.

6. The apparatus of claim 1, wherein at least one of the first, second or third folding lines is formed by a groove.

7. The apparatus of claim 1, wherein the first folding line and second folding line are not parallel to one another.

* * * * *